US007567149B2

(12) United States Patent
Wen et al.

(10) Patent No.: US 7,567,149 B2
(45) Date of Patent: Jul. 28, 2009

(54) SUBWAVELENGTH WAVEGUIDE AND DELAY LINE WITH FRACTAL CROSS SECTIONS

(75) Inventors: Weijia Wen, Kowloon (HK); Ping Sheng, Kowloon (HK); Che Ting Chan, New Territories (HK); Lei Zhou, Shanghai (CN); Bo Hou, Kowloon (HK)

(73) Assignee: The Hong Kong University of Science and Technology, Hong Kong (CN)

( * ) Notice: Subject to any disclaimer, the term of this patent is extended or adjusted under 35 U.S.C. 154(b) by 261 days.

(21) Appl. No.: 11/398,464

(22) Filed: Apr. 5, 2006

(65) Prior Publication Data

US 2007/0236312 A1 Oct. 11, 2007

(51) Int. Cl.
*H01P 1/18* (2006.01)

(52) U.S. Cl. ..... 333/157; 333/248

(58) Field of Classification Search ..... 333/239, 333/248, 157

See application file for complete search history.

(56) References Cited

U.S. PATENT DOCUMENTS 2,840,788 A * 6/1958 Mullett et al. ..... 333/157
2003/0227360 A1* 12/2003 Kirihara et al. ..... 333/239

OTHER PUBLICATIONS

Ebbesen, et al., "Extraordinary optical transmission through subwavelength hole arrays," Nature, vol. 391, Feb. 12, 1998, pp. 667-669.

Porto, et al., "Transmission Resonances on Metallic Gratings with Very Narrow Slits," Physical Review Letters, vol. 83, No. 14, Oct. 4, 1999, pp. 2845-2848.

* cited by examiner

*Primary Examiner*—Benny Lee
(74) *Attorney, Agent, or Firm*—Heslin Rothenberg Farley & Mesiti P.C.

(57) ABSTRACT

A waveguide structure is described wherein microwaves or radio-frequency waves can be guided in their propagation through channels whose cross-sections contain fractal patterns, with relevant dimensions much smaller than the wavelengths of the guided waves. A finite section of such waveguide can be used as an efficient delay line.

17 Claims, 5 Drawing Sheets

(a) (b)

SUBWAVELENGTH WAVEGUIDE AND DELAY LINE WITH FRACTAL CROSS SECTIONS

FIELD OF THE INVENTION

This invention relates to a novel subwavelength waveguide and delay line with fractal cross sections, applicable to radio waves, microwaves and up to terahertz waves.

BACKGROUND OF THE INVENTION

In conventional metallic waveguides, the cut-off frequency for the transmission of electromagnetic (EM) waves depends on the transverse dimension of the waveguide. That is, the longer the wavelength of the guided waves, the larger the transverse dimension of the waveguide must be. Thus for long-wavelength microwave or radio waves it may not be practical to have EM waveguides since the transverse dimensions would have to be very large.

Recently, it has been shown that EM wave transmission through a silver film with a periodic array of subwavelength holes can be significantly higher than the conventional prediction. Subsequently, two possible mechanisms to realize high transmission of EM waves were identified. One is the surface plasmon (SP) resonance, which explains the Ebbesen experiments, and the other is the waveguide mode resonances inside metallic slits due to the Febry-Perot (FP) interferences. In the SP mechanism, enhanced transmission can only be achieved if the metallic film is very thin, due to the evanescent coupling. Hence such a mechanism is not suitable for waveguide considerations. In the second mechanism, involving the slit geometry, there is a fundamental TEM propagating wave mode. However, the latter requires at least one dimension of the slit cross section be comparable to the relevant wavelength, a well-known limitation for the propagation of EM wave in waveguides and resonant cavities.

Another component widely used in EM wave and electronic signal transmission is the delay line. For free space propagation of EM waves, a piece of dielectric plate can have delay functionality through which EM wave penetrates. However, such plates can delay only by a small amount due to the generally low dielectric constant of materials at high frequencies, and the limited thickness of the plate. Therefore, reducing the thickness and increasing the dielectric constant are advantageous for EM wave delay line functionality.

SUMMARY OF THE INVENTION

According to the present invention there is provided a waveguide comprising a cross-section having a fractal pattern normal to the direction of propagation of radiation to be transmitted through the waveguide.

In embodiments of the present invention the waveguide may take one of two complementary forms.

In particular in one embodiment the fractal pattern is created by a metal element located within the waveguide and extending in the direction of propagation, wherein the metal element is formed with the fractal element in cross-section. In this embodiment the metal element is surrounded by air or by a dielectric material.

In an alternative embodiment the fractal pattern is created by an air channel formed in a solid material that occupies the interior of the waveguide, the air channel extending in the direction of propagation and being formed with the fractal element in cross-section. In this embodiment the solid material may be a metal or may be a dielectric material with the interior surfaces of the dielectric material defining the air channel being formed with a metal surface.

The parameters of the fractal pattern may be varied depending on the desired transmission characteristics of the waveguide. Typically, however, the fractal pattern may be formed with from 2 to 20 levels and with the mother element being an H-shape that is subject to scaling and rotational transformations. With regard to the size of the mother element, this may be selected depending on the wavelength to be transmitted. Generally a larger mother element results in a lower frequency of transmission. The possible size of the mother element may vary from a few hundred microns to 0.5 m depending on the desired transmission frequency. For example, for transmission in the microwave range, a mother element with a maximum dimension of less than 30 cm may be used.

In some embodiments of the invention the waveguide may comprise in cross-section an array of fractal patterns. An array of identical fractal patterns may, for example, be advantageous if the transverse dimensions of the EM wave to be propagated are significantly greater than the size of a single fractal pattern, while an array of different fractal patterns may be used to form a waveguide with multiple-frequency transmission bands.

According to a further aspect of the present invention there is also provided an electromagnetic wave delay element comprising a waveguide comprising a cross-section having a fractal pattern normal to the direction of propagation of radiation to be transmitted through the waveguide.

BRIEF DESCRIPTION OF THE DRAWINGS

Some embodiments of the invention will now be described by way of example and with reference to the accompanying drawings, in which.

DETAILED DESCRIPTION OF PREFERRED EMBODIMENTS

As will be seen in more detail from the following description, at least in preferred forms the present invention provides metallic waveguides consisting of narrow H-fractal channels embedded in (or coated by) a good conductivity metal. Alternatively an inverted structure is possible where the metallic fractal is embedded in air or dielectric, with the whole structure enclosed by a metallic casing. Such waveguides can be subwavelength in all cross sectional dimensions, thereby allowing compact designs for guided propagation of long-wavelength EM waves. Here the maximum transmission magnitude can be nearly 100%, with efficient coupling. The underlying physics is governed by the transverse fractalshaped hollow channel/metallic structure, allowing for transverse subwavelength resonances. The measured results indicate that such waveguides can provide low-loss propagation of EM waves, and for finite sections of such waveguides the allowed frequencies are discrete, with the fundamental lowest frequency mode allowing for no phase change in transmission. Pulse transmission through such finite section of the waveguide can be significantly slowed down compared to free space propagation, by orders of magnitude.

Test samples were prepared with stainless steel plate with different thicknesses on which a periodic array of fractal slits was generated by a diamond wire cutter. The unit cell of the array consists of a five-level structure, wherein the width of each slit is 0.6 mm, with the longest slit being 1 cm. A total of 25 fractal slit units were made on a 12×12 $cm^2$ steel plate.

Figure 1:
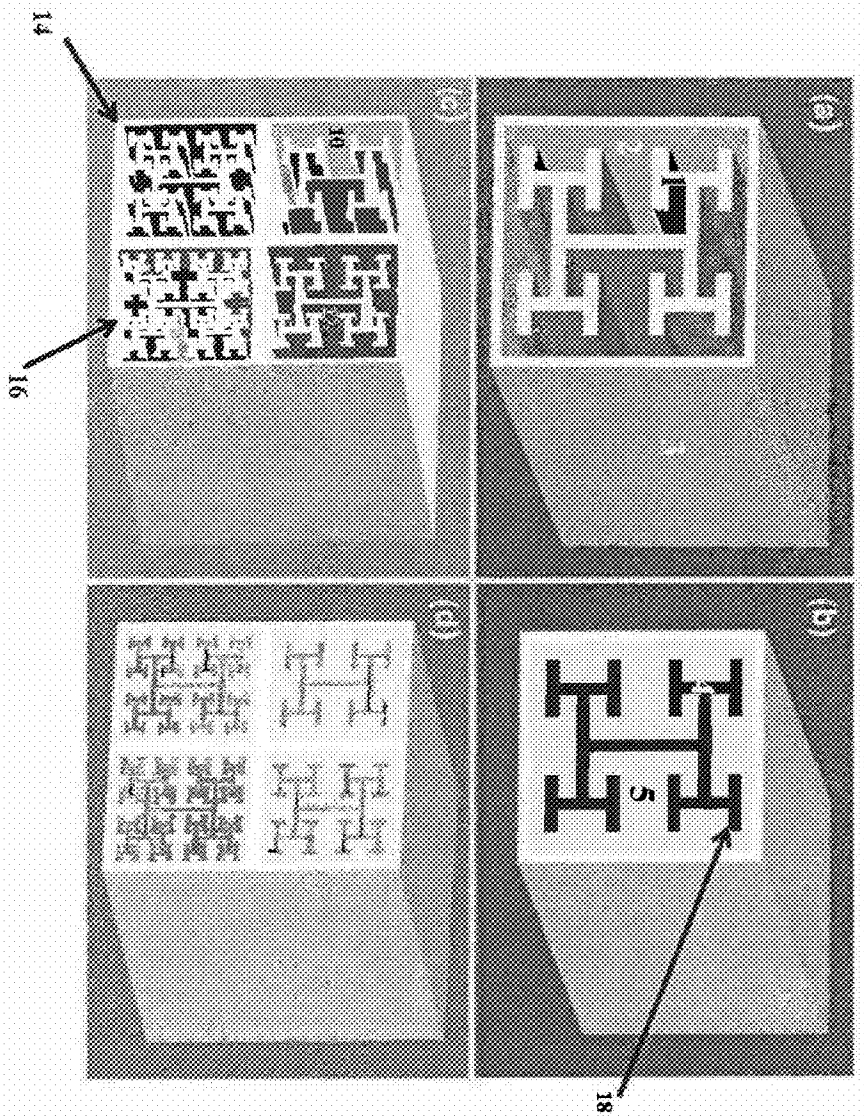
FIG. 1 shows schematically a number of possible design variations for the H-fractal waveguides of embodiments of the present invention.

FIG. 1 shows a selection of possible fractal waveguide designs. FIGS. 1(*a*) and 1(*b*) are the waveguides with 4 levels where the repeating element is an H-shaped element. FIG. 1(*a*) shows a design in which the fractal element is a metal element 1 surrounded by air 2 within a metal waveguide housing 3. FIG. 1(*b*) shows the complementary inverse design in which the fractal element 4 comprises an air channel formed in a dielectric material 5 that fills the interior space of the waveguide, a metal surface 18 on the dielectric forming the air channels. In the embodiment of FIG. 1(*b*) as an alternative to forming the air channels 4 within a dielectric material provided with a metallic coating, the air channels 4 could instead simply be formed in a metal.

FIGS. 1(*c*) and 1(*d*) illustrate various possible waveguide structures which may be provided independently or could be combined into a single waveguide to accommodate multiple frequency regimes. In these different structures the number of levels of the waveguide pattern and the size of the fundamental element may be varied depending on the desired transmission frequency. FIG. 1(*c*) shows four fractal patterns 10, 12, 14, and 16 with 4, 5, 6 and 7 levels, respectively, formed as metal fractal elements in air, and FIG. 1(*d*) shows the same patterns formed as air channels in a dielectric or metal.

In practical embodiment of the invention the parameters of the fractal pattern may be varied depending upon the desired application. Typically, for example, the pattern may comprise a fractal pattern formed having from 2 to 20 levels. Preferably the mother element is an H-shape with a transformation comprising scaling and rotation.

Figure 2:
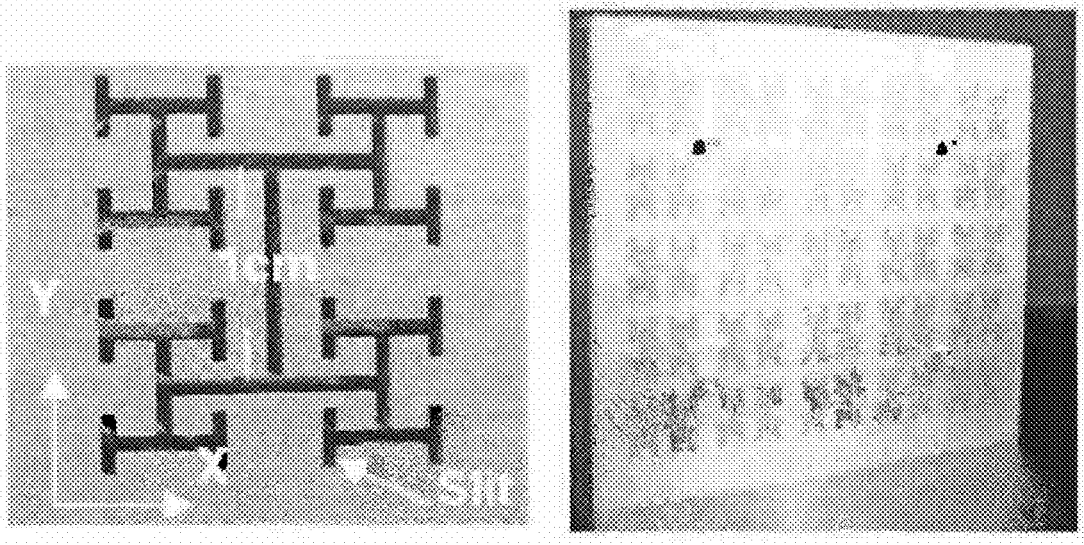
FIG. 2 shows an example of a sample fabricated with stainless steel plate on which hollow fractal slits are generated for use in an embodiment of the invention.

FIG. 2(*a*) is an example of a fractal element prepared using a stainless steel plate on which a fractal pattern was generated by cutting slots in the steel plate a diamond wire cutter. The fractal pattern consists of a five-level structure, wherein the width of each slit is 0.8 mm, with the longest slit being 1 cm, as shown in FIG. 2(*a*). Where the incident beam is relatively narrow, or may be reduced in width prior to passing through the waveguide, a single fractal element may be used. However, if the incident beam is relatively wide a single fractal element may be insufficient and in such cases an array of fractal elements may be used. An example of this possibility is shown in FIG. 2(*b*) where six samples were prepared each comprising a total of 25 fractal patterns each being as shown in FIG. 2(*a*) formed in a 12 ×12 $cm^2$ steel plate in a 5×5 array. The "x, y" in FIG. 2*a* provides standard orientation. The samples differed in thickness: 0.5 mm, 2.0 mm, 5.5 mm, 8.5 mm, 11.5 mm and 14.5 mm. In practical embodiments the waveguide may be of any length and so the "thickness" of the fractal pattern (i.e., its dimension in the direction of propagation) may be from a few microns to many meters.

To obtain experimental measurements using these embodiments, the samples were mounted in the central window (with the same size as the 12×12 $cm^2$ plate) of a 100×100 cm steel plate so as to prevent microwave transmission through channels other than the fractal slit array. Microwave transmission spectra were then measured by a network analyzer (Agilent 8720ES). Two identical microwave horns (HP11966E) were used to generate and receive the signals separated by a distance of 100 cm. The sample was placed on a stage, 15 cm from the receiving horn. The microwave polarization was such that the electric field was perpendicular to the shortest slits of the fractal pattern (defined as $E_{\perp}$, while $E_{//}$ is 90° rotated). All measured spectra were normalized to the transmission when no sample is mounted. Transmission measurement for a single fractal slit aperture was also carried out, by covering all the 24 apertures of the array with metallic sheets, leaving open only the center one.

Figure 3:
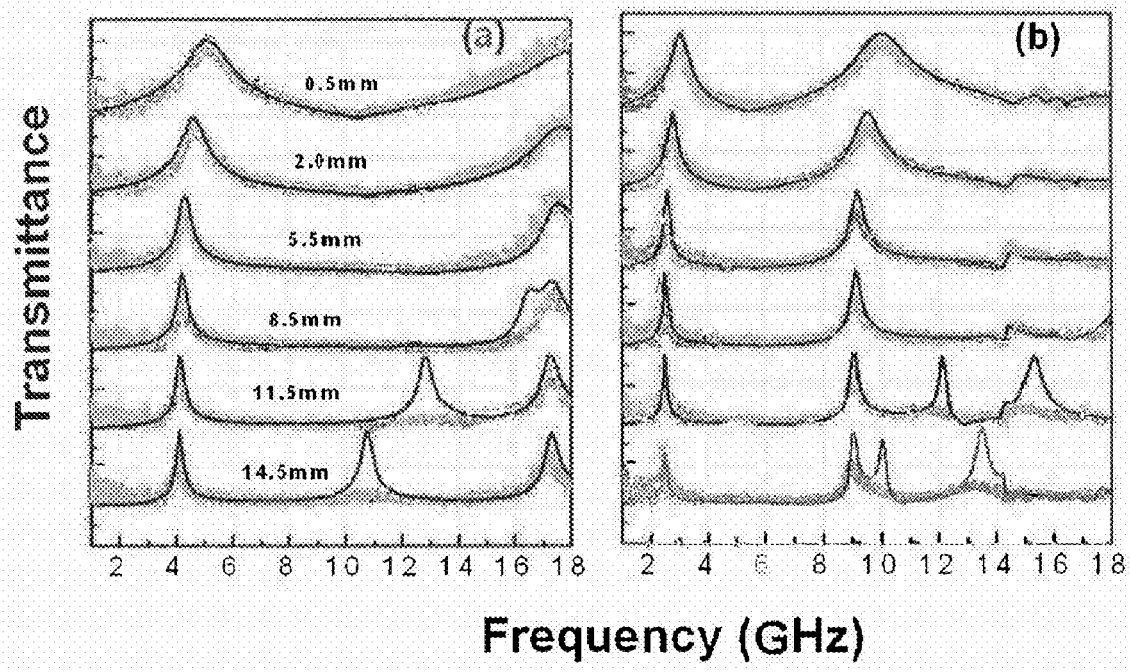
FIG. 3 shows the transmittance of microwave radiation through a slit array with different thicknesses, for two polarizations; where (a) and (b) are for $E_{//}$ and $E_{\perp}$, respectively.

FIGS. 3(*a*) and 3(*b*) show the microwave transmission spectra through the slit array for two polarizations, where (a) and (b) are for $E_{//}$ and $E_{\perp}$, respectively. Frequency in GHz is shown along the x axis, while transmittance is shown along the y axis. One grid unit in the y- axis represents 50% transmission. It can be noted that for the 0.5 mm thick sample, approximately 100% transmittance can be identified at frequencies of 5.1 GHz and >18 GHz for the case of $E_{//}$, and 3.0 GHz and 10.0 GHz for the case of $E_{\perp}$. The peak transmission frequency is downshifted slightly when the thickness of stainless steel plate increases from 0.5 mm to 5.5 mm, beyond which it stayed constant (4.1 GHz and 17.2 GHz for $E_{//}$, 2.4 GHz and 9.0 GHz for $E_{\perp}$) up to the maximum sample thickness of 14.5 mm. While not shown, the transmission through a single fractal aperture was measured to be 9%. This reduced transmission is mainly due to the fact that the incident beam size is larger than the single fractal aperture.

It should be noted that at the lowest peak frequency, the incident wavelength (12.5 cm) is 12.5 times the longest slit (1 cm) on the steel plate. Hence the aperture cross section can be significantly subwavelength in both dimensions.

The transmission characteristics of the fractal slit array were investigated by finite difference time domain (FDTD) simulations in which an infinite plane tiled by a periodic replica of the 5-level fractal slit patterns is considered, with one unit cell with periodic conditions imposed at the outer boundaries being studied. Perfect conductor boundary conditions, excellent for microwave frequencies, were applied to the metal/air interfaces. The simulation results are shown as solid lines in FIGS. 3(*a*) and 3(*b*). Very good agreements are seen.

Figure 4:
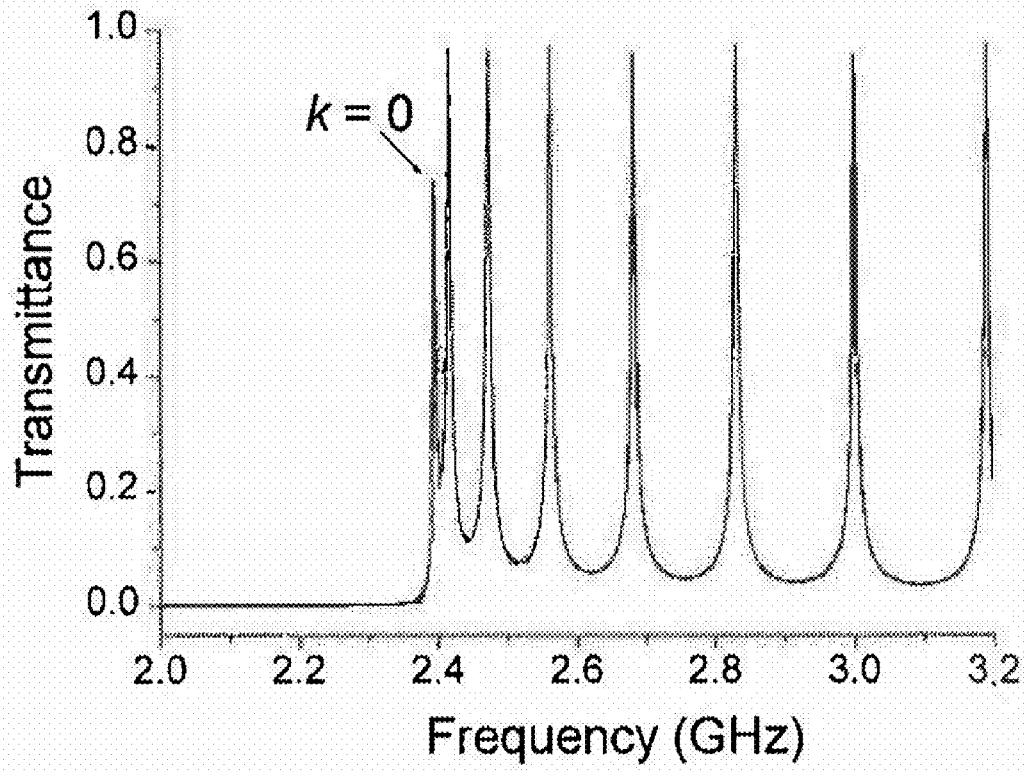
FIG. 4 shows simulation results for transmittance through a 5×5 fractal slit array that is 50 cm in length, for the $E_{\perp}$ polarization as a function of frequency.

FIG. 4 shows the simulation result for a 5×5 array of fractal slits that are 50 cm in thickness. In the simulation, periodic boundary condition and perfect conductor approximation were assumed as above. It is seen that increased thickness means many more transmittance peaks at various frequencies. However, the 2.4 GHz transmission peak is preserved, with a narrower width. As the thickness is now many wavelengths, the lowest frequency transmission may be viewed as a k=0 waveguide mode. As the waveguide length increases, the discrete transmission peaks will merge into a band, with the k=0 waveguide mode becoming the cutoff frequency for the waveguide. The 2.4 GHz peak (the arrow indicates the k=0 peak) becomes extremely narrow, so that it can not be resolved completely and thereby appears lower than 100%. When the waveguide length approaches infinity, the discrete transmission peaks merge to form a transmission band, with the original k=0 peak becoming the cutoff frequency for the waveguide.

Figure 5:
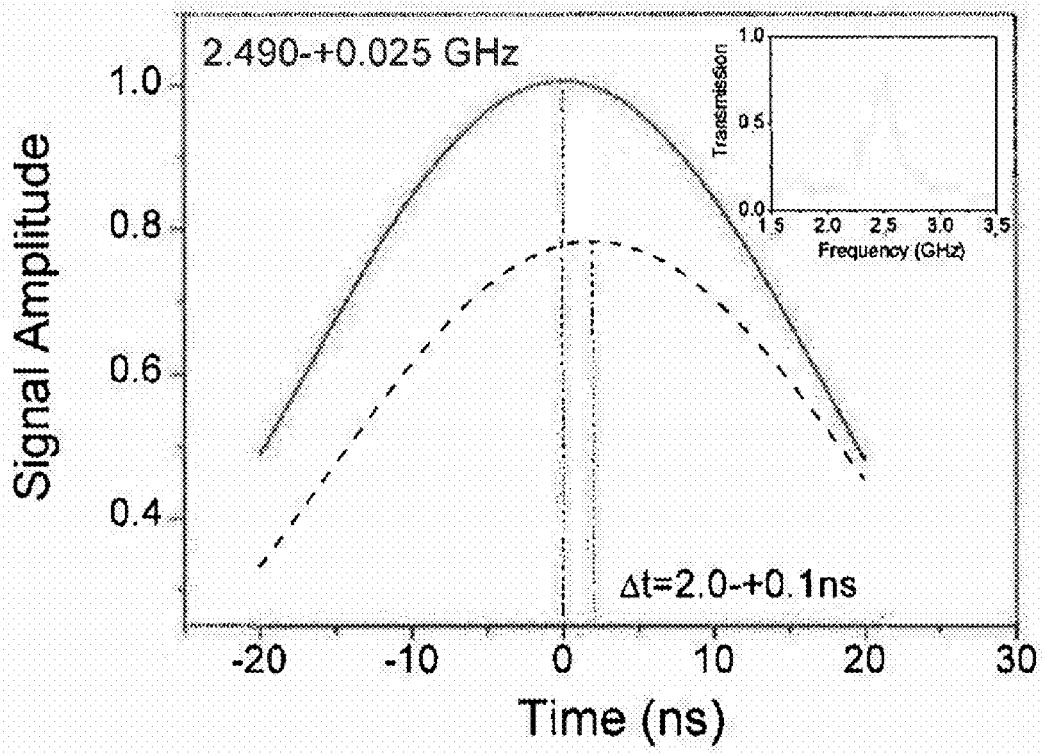
FIG. 5 shows experimentally measured time delay for a Gaussian pulse (central frequency: 2.490 GHz with a frequency width of 50 MHz) passing through an 8.0 mm-thick sample according to an embodiment of the invention.

The experimental investigation for time delay functionality was carried out with a 8.0 mm thick sample and tested with a network analyzer. In the experiments, normalization for the network analyzer was carried out by first recording the EM pulse traveling freely through the central window, with no sample. With the sample in place, the pulse flight was recorded again. By comparing the two results, the time delay of EM waves passing through the sample with respect to free space of identical distance was determined. FIG. 5 shows the measured results for a Gaussian pulse with central frequency at 2.490 GHz and 50 MHz in frequency width (see inset graph), where the solid line represents the pulse flight in free space and the dashed line the pulse flight through the sample. It can be seen that the time delay is 2.0 nsec, indicating a reduced group velocity by a factor of 75, compared to that of the free space.

It will thus be seen that, at least in its preferred forms, the present invention provides a structure for a waveguide where the guided waves can have wavelength(s) one order of magnitude or larger than the transverse dimensions of the waveguide. A finite section of the waveguide can act as a delay line. The pulse transmission at a prescribed frequency range can be orders of magnitude slower than that in vacuum, making a short section very effective in delaying the arrival time of the pulse. By using H-fractal cross sections, EM waveguides with cross-sectional dimensions significantly smaller than the guided wavelength can be achieved. This would make possible compact waveguides for microwaves and even (higher-frequency) radio waves.

The invention claimed is:

1. A waveguide comprising a cross-section having a fractal pattern normal to the direction of propagation of radiation to be transmitted through the waveguide.

2. A waveguide as claimed in claim 1 wherein said fractal pattern comprises a metal element located within said waveguide and extending in the direction of propagation, wherein said metal element is defined with said fractal pattern in cross-section.

3. A waveguide as claimed in claim 2 wherein said metal element is surrounded by air.

4. A waveguide as claimed in claim 2 wherein said metal element is surrounded by a dielectric material.

5. A waveguide as claimed in claim 1 wherein said fractal pattern comprises an air channel disposed in a solid material that occupies the interior of said waveguide, said air channel extending in the direction of propagation and being defined with said solid material in cross-section.

6. A waveguide as claimed in claim 5 wherein said solid material is a metal.

7. A waveguide as claimed in claim 5 wherein said solid material is a dielectric material and the interior surfaces of said dielectric material defining said air channel including a metal surface thereon.

8. A waveguide as claimed in claim 1 wherein the fractal pattern comprises fractals with 2 to 20 levels.

9. A waveguide as claimed in claim 1 wherein the fractal pattern comprises an H-shaped mother element subject to scaling and rotation transformations.

10. A waveguide as claimed in claim 1 wherein the waveguide is encased in a shell of metal or insulating materials.

11. A waveguide as claimed in claim 1 wherein said cross-section comprises an array of fractal patterns.

12. A waveguide as claimed in claim 11 wherein said array comprises identical fractal patterns.

13. A waveguide as claimed in claim 11 wherein said array comprises different fractal patterns.

14. A waveguide as claimed in claim 1 wherein the radiation comprises an EM wave, and wherein the propagation through the waveguide is slowed compared with propagation through free space.

15. A waveguide as claimed in claim 1 wherein a low-frequency stop/pass band(s) has at least one frequency regime wherein all cross sectional dimensions of the fractal pattern are smaller than a wavelength at said at least one frequency regime.

16. A waveguide as claimed in claim 1 wherein a lowest-frequency transmittance cutoff is determined by the k=0 mode at finite waveguide length.

17. An electromagnetic wave delay element comprising a waveguide comprising a cross-section having a fractal pattern normal to the direction of propagation of radiation to be transmitted through the waveguide.

* * * * *